United States Patent [19]

Portmann

[11] Patent Number: 4,854,152

[45] Date of Patent: Aug. 8, 1989

[54] RAM GUIDING APPARATUS FOR A PUNCH PRESS

[75] Inventor: August T. Portmann, Arbon, Switzerland

[73] Assignee: Bruderer Ag, Frasnacht-Arbon, Switzerland

[21] Appl. No.: 190,538

[22] Filed: May 5, 1988

[30] Foreign Application Priority Data

May 22, 1987 [CH] Switzerland ..... 2001/87

[51] Int. Cl.[4] ..... B21D 37/12

[52] U.S. Cl. ..... 72/456; 100/214

[58] Field of Search ..... 72/455, 456, 453.01; 100/214, 282, 918

[56] References Cited

U.S. PATENT DOCUMENTS

| | | | |
|---|---|---|---|
| 3,861,192 | 1/1975 | Suzuki et al. | 72/456 |
| 4,419,878 | 12/1983 | Fusser | 72/456 |

FOREIGN PATENT DOCUMENTS

| | | | |
|---|---|---|---|
| 3712121 | 10/1987 | Fed. Rep. of Germany | 72/456 |
| 0092125 | 5/1984 | Japan | 72/456 |
| 1159801 | 6/1985 | U.S.S.R. | 72/456 |

*Primary Examiner*—David Jones

*Attorney, Agent, or Firm*—Ladas & Parry

[57] ABSTRACT

The guide columns of the punch press are releasably mounted to the base plate. Guide sleeves project from the ram and the guide columns are guided inside of the these guide sleeves. The sealing between the guide columns and the guide sleeves is made by piston rings. Leakage oil is collected at the oil collecting ring and discharged through a transfer channel (11) located in the ram (2) towards an inner space of the guide sleeve. A horizontally mounted check valve is located in this oil transfer channel. The guide column includes a leakage oil channel which extends to the oil collecting space in the base plate. In operation oil present in the oil collecting ring is pumped into the oil collecting space due to the continously changing of the volume of the inner chamber such that no leakage oil can enter the punching work space. The check valve opens during the upwards movement of the ram and closes during the downwards movement thereof. Those sections of the guide columns which incorporate a sealing and guide function are surrounded by the respective guide sleeve at all operational positions of the ram and are accordingly protected against injury. By means of the above design a penetrating of lubricating oil into the punching works space is impossible and no large loss of lubricating oil is possible.

8 Claims, 1 Drawing Sheet

RAM GUIDING APPARATUS FOR A PUNCH PRESS

BACKGROUND OF THE INVENTION

1. Field of the Invention

The present invention relates to a ram guiding apparatus for a punch press. The punch press includes a ram, at least one connecting rod driving ram, and a base plate defining the lower limit of the punching work space and guide columns operative to guide the ram.

2. Description of the Prior Art

With regard to punch presses which include guide columns for the guiding rams, a variety of designs regarding the mounting of the guide columns are known and applied. According to a number of designs the guide columns are mounted relative to the punching work space at the top and the at bottom to the machine frame. These designs include guide columns which are mounted directly at the ram and are guided at the top and at the bottom or at the bottom only in the machine frame. In high speed punch presses in which the ram experiences large accelerations it is quite difficult to discharge leakage oil stemming from the lubrication of the machine such that no lubrication oil which has leaked out flows into or penetrates respectively, the punching work space. A large number of punching operations necessitate, however, an impeccably dry punching work space. Furthermore, if the punching tool itself is operated with punching oil specific care must be taken that the lubricating oil, occurs in an extremely small amount such (1) the lubricating oil will not be mixed with the punching oil so as to degrade and (2) there is no excessive loss of lubrication oil.

SUMMARY OF THE INVENTION

It is a general object of the present invention to provide an improved ram guiding apparatus for a punch press in which leakage oil is safely guided away from the punch working space.

A further object of the invention is to provide a ram guiding apparatus for a punch press having a ram which comprises a plurality of a guide sleeve projecting therefrom towards the base plate; in which every guide column is mounted to the base plate and projects guided into a respective guide sleeve; and in which every guide column is provided with piston rings sealing against the respective guide sleeve and having joints which are arranged staggered relative to each other.

Yet, a further object is to provide a ram guiding apparatus having guide sleeves which are releasably mounted to the base plate whereby every guide sleeve is replaceable together with its guide column as one unit without having to disassemble the punch press.

A further object is to provide a ram guiding apparatus for a punch press in which every guide sleeve is displaceable relative to its guide column in a horizontal direction such to allow for a thermal expansion, which direction is defined at least approximately by a straight line connecting the axis of the guide columns located diametrically opposite to each other relative to the center point of the base plate.

BRIEF DESCRIPTION OF THE DRAWING

The invention will be better understood and objects other than those set forth above will become apparent when consideration is given to the following detailed description thereof. Such a description makes reference to the annexed drawings wherein.

DESCRIPTION OF THE PREFERRED EMBODIMENT

Figure 1:
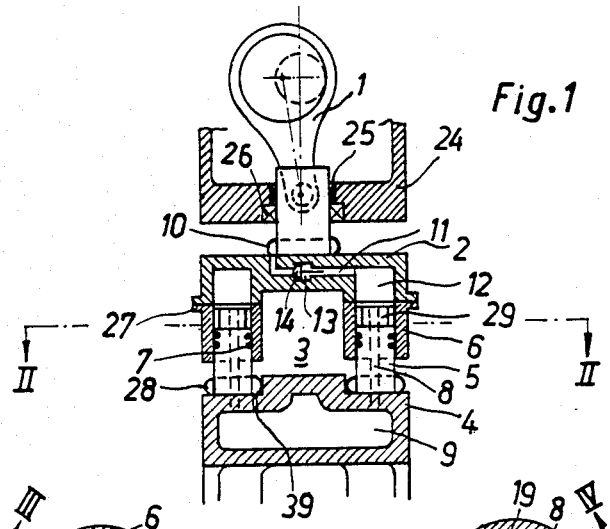
FIG. 1 illustrates a simplified section through a part of a punch press.

Referring initially to FIG. 1 reference numeral 1 identifies a connecting rod of a punch press which is driven via a crank shaft or eccentric assembly according to well known designs. This connecting rod 1 drives in turn ram 2. The punching work space 3 is located under the ram 2 which punching work space 3 is limited at its bottom by the base plate 4 which is also called a punching table. FIG. 1 illustrates, furthermore, a upper part 24 of the machine frame as well as a upper guide 25 and upper seal 26. A oil collecting chamber 9 is located in or below respectively the base plate 4. Seated on ram 2 is an oil collecting ring 10 for collecting leaking oil.

Guide sleeves 6 are mounted to the ram 2 which guide sleeves 6 project towards the base plate 4. These guide sleeves 6 are releasably mounted to the ram 2 whereby releasable connection joint is generally identified by the reference numeral 27. The particular illustration shows a flange joint, it is, however, obvious that any known design of a releasable joint or mounting, is possible. The guide columns identified by the reference numeral 5 are releasably mounted to the base plate 4. The oil collecting rings located on the base plate 4 are identified by the reference numeral 28 and any leakage oil collected in these oil collecting rings flows via passages 39 into the oil collecting chamber 9. The means by which the guide columns 5 and guide sleeves 6 are guided relative to each other are identified in FIG. 1 generally by the reference numeral 29 and particulars of designs thereof will be explained further below based on FIGS. 2–6. The sealing between the respective guide columns 5 and guide sleeves 6 is formed by piston rings 7. Until now exclusively sealing gaskets have been used at the corresponding locations because the prior art has not realized and recognized the superiority of the piston rings at this location. The joints of the respective piston rings 7 are arranged staggered relative to each other. Although the illustrated embodiment incorporates two piston rings, it is quite obvious that the number of piston rings can be selected freely in accordance with the prevailing conditions.

A leakage oil channel 8 passes through each guide column 5 which leakage oil channel 8 communicates at the upper end of the respective guide column 5 with the inner chamber 12 of the guide sleeve 6 above the end of the guide column 5 and communicates at its lower end with the oil collecting chamber 9.

It already has been mentioned that an oil collecting ring 10 of common generally known design is located on the ram 2 and intended to collect any leakage oil. A transfer channel 11 is formed in the ram 2. This transfer channel 11 runs from the oil collecting ring 10 through the ram 2 and up to mentioned inner chamber 12 of one of the guide sleeves. As a result, the leakage oil which has collected in the oil collecting ring 10 will flow through the transfer channel 11 into the inner chamber 12 of the guide sleeves 6 and from there further through the leakage oil channel 8 into the oil collecting chamber 9.

A check valve 13 is located within the transfer channel 11. This check valve 13 can be designed in accordance with any general known manner, important to note is, however, that the valve body 14 of this check valve 13 is arranged such that it moves in a horizontal direction. Therefore, the valve body 14 is never subject to accelerating forces which could detrimentally influence or hamper its function. The object of the check valve 13 is to cause a forced discharge of the oil collected within the oil collecting ring 10. Hereto, attention is drawn now to the right hand side of FIG. 1. In operation of the machine the ram 2 and accordingly the respective guide sleeves 6 move relative to the fixed guide columns 5. As a result, the volume of the inner chamber 12 of the guide sleeves 6 change continuously. This continuous changing of the volume is now utilized for a positive discharging of the leakage oil. If the ram 2 moves upwards relative to the guide sleeves 6 the volume of the inner chamber 12 increases and accordingly a vacuum is generated which causes a suction action within the transfer channel 11. The check valve 13 or valve body 14 are designed so that the suction action lifts valve body 14 off it seat (against the action of a spring force so that valve body 14 moves to the right side of the punch press as shown in FIG. 1) so as to open the transfer channel 11. The vacuum or below atmospheric pressure in the inner chamber 12 of the guide sleeve 6 or suction action in the transfer channel 11, acts upon the oil collecting ring 10 so as to cause a transfer or transport of the leakage oil through the transfer channel 11. Accordingly, the leakage oil flows into the inner chamber 12.

Immediately following the downwards movement of the ram 2 and guide sleeve 6, the volume of the inner chamber 12 decreases and accordingly the pressure therein increases such that the check valve 13 closes. The closing of the check valve 13 prevents a blowing out of air which would entrain leakage oil which also would be transported back. The inner chamber 12 communicates via the leakage oil channel 8 with the oil collecting chamber 9. Due to the pressure build up in the inner chamber 12 an air flow is generated in the leakage oil chamber 8 which is directed towards the oil collecting chamber 9 such that the leakage oil is not only transported into the oil collecting chamber 9 by gravitational forces but by the air flow.

Accordingly, it may be stated that the leakage oil stemming from the upper guide and exiting from the upper seal of the punch press is pumped off or sucked off according to a absolutely novel procedure such that the discharging of the leakage oil proceeds by a positive action and not only by a gravitational force. Because the atmosphere within the oil collecting chamber 9 is also subjected to pressure changes, valves having the similar function are mounted inside the discharge channel 39. The valves, however, are not shown in the drawings.

Figure 4:
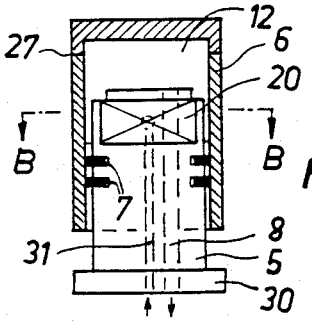
Figure 5:
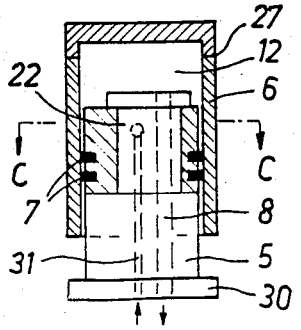
Figure 6:
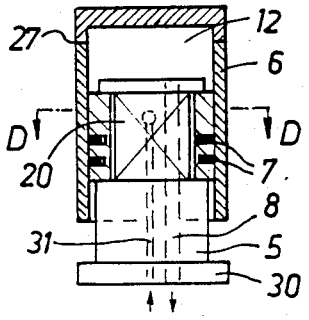

Every guide sleeve 6 is releasably mounted to the ram 2 such as generally indicated by means of the reference numeral 27 in FIG. 1. Every guide column 5 is also releasably mounted to the base plate 4. This mounting is not specifically illustrated in FIG. 1 because such can be designed in accordance with any general known arrangement. For illustrative purposes only a mounting flange 30 is indicated in FIGS. 4–6. Because the guide sleeves 6 as well the guide columns 5 are releasably mounted to their respective supports every guide sleeve 6 can be exchanged together with its guide columns 5 as unit without the necessity of disassembling the punch press.

The illustrated design incorporates yet a further considerable advantage. It is possible that the guide columns may be damaged by metal pieces, produced by the material being punched, inpringing upon the columns. As a result, the various parts which make up the guide assemblies can be damaged. In the illustrated design guide sleeve 6 protects guide column 5. It is specifically to be noted that if the ram 2 is in its upper dead center the piston rings 7 forming the seals as well the guides 29 are completely encased by the respective guide sleeve 6. Accordingly, any damage or injury to the guide columns 5 at the areas of the seals and of the guides is absolutely impossible. This is in contrast to all known designs in which sections of the guide columns which cooperate with seals or with guide members are exposed to damage by flying debris.

During the punch press operation, the ram and the base plate experience different thermal expansions. Although this differential expansions are extremely small having a magnitude for instance of 1/100 mm they detrimentally influence the precision and quality of the product manufactured by the punch press or tool, repsectively.

Figure 2:
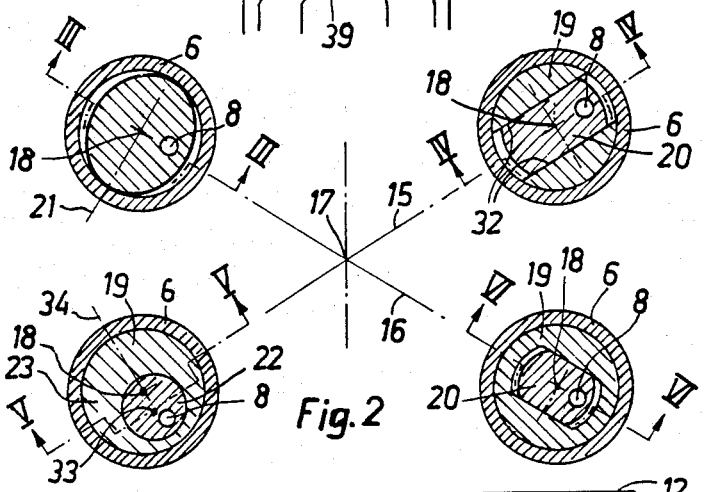
FIG. 2 illustrates horizontal sections through varies embodiments of ram guiding designs.

FIG. 2 illustrates horizontal sections through four embodiments of designs taking up relative expansion differences between ram and base plate. The illustration is a view of a section through a punch press having four guide columns which section proceeds along line II—II of FIG. 1. Each of the four sectional views of FIG. 2 illustrate one individual design for the taking up of relative expansions between ram and base plate. Basically, some particular designs of guide sleeves 6 and guide columns 5 are illustrated which allow a horizontal relative movement whereby the direction of such moving or displacement coincides at least approximately with a straight line 15 and 16, which connects the longitudinal axes of the guide columns 5 which are located diametrically opposite to each other relative to the center point 17 of the base plate 4.

Figure 3:
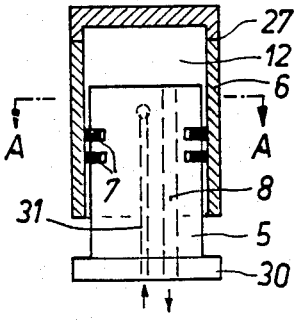
FIGS. 3–6 illustrate vertical sections through the respective embodiments shown in FIG. 2.

First, attention is now drawn to the embodiment of FIG. 2 illustrated in the upper left quadrant and furthermore to FIG. 3. FIG. 2 illustrates at the upper left hand side a section along line A—A of FIG. 3, and FIG. 3 illustrates in turn a section along line III—III of FIG. 2. FIG. 3 illustrates a guide column 5 including its leakage oil channel 8 and lubricating oil supply channel 31. Two piston rings 7 are installed in the guide column 5 which piston rings 7 seal against the guide sleeve 6. For the sake of good order only reference numeral 27 indicates the releasable mounting or connection, respectively between the guide column 6 and the ram 2 without illustrating any particulars which are of well known design. The guide column 5 is designed to have an oval or at least approximately an elliptical cross sectional shape. The major axis 21 of the illustrated ellipse extends perpendicularly to the straight line 16 connecting the above identified axis 18 of the corresponding guide columns 5. The free space between the outer surface of the guide column 5 and the inner surface of the guide sleeve 6 is designed exaggerated for illustration purposes only. The relative movements due to differential thermal expansions lie within the range 1/100 mm. It is now obvious that the relative movement between the guide sleeve 6 and the guide column 5 is possible in the direction of the above mentioned straight line 16.

A further embodiment is illustrated in the upper right hand quadrant of FIG. 2.

FIG. 2 illustrates a section along line B—B of FIG. 4 and correspondingly FIG. 4 illustrates a section along line IV—IV of FIG. 2. Again a guide column 5 including the exemplary mounting flange 30, the leakage oil channel 8 and lubricating oil supply channel 31 as well as the sealing piston ring 7. Furthermore, the guide sleeve 6 as well as the releasable mounting 27 are illustrated. The guide column 5 is provided with a head section 20 which includes two planar side face 32 such as indicated in FIG. 2. This head section 20 having a somewhat elongated shape is inserted into a guide mmber 19 which can also be made in two parts such as the illustrated example indicates. This guide member 19 abuts or contacts, respectively the inner surface of the guide sleeve 6. The clearance between the curvilinearly extending face sides of the head section 20 and the corresponding sections of the inner surface of the guide sleeve 6 is again illustrated overly large for sake of clarity. It is now obvious that the relative movement between the guide sleeve 6 with the guide members 19 and the head section 20 of the guide column 5 is possible in direction of the straight line 15.

The quadrant at the lower right hand side of FIG. 2 illustrates a section along line D—D of FIG. 6 which illustrates in turn the section along line IV—IV of FIG. 2. This embodiment has a certain similarity to the embodiment of FIG. 4. The difference is that the head section 20 of the guide column 5 is kept somewhat shorter and that the guide member 19 is a one piece structure. Also, a relative movement in the direction of the straight line 16 is possible.

A further embodiment is illustrated in the lower left hand quadrant of FIG. 2 and in FIG. 5. FIG. 5 illustrates a section along line V—V of FIG. 2 and that illustration is a view of a sectional long along line C—C of FIG. 5. In this embodiment which regarding the general structure corresponds to the previous embodiments an excentrically located trunnion 22 is arranged on top of the guide column 5. This trunnion projects into the guide member 23 having a correspondingly eccentrically located receiving opening. The axis 18, that is the center axis of the column 5 or sleeve 6 and the axis line 33 of the trunnion 22 defines a straight line 34 which extends perpendicularly to the connecting straight line 15. A relative movement between the guide column 5 and the guide sleeve 6 directed approximately parallel to the connecting straight line 15 generates a corresponding rotational movement of the guide member 23 in the guide sleeve 6.

While there are shown and described present preferred embodiments of the invention, it is to be distinctly understood that the invention is not limited thereto, but may be otherwise variously embodied and practised within the scope of the following claims.

I claim:

1. A ram guiding apparatus for a punch press which punch press includes a ram and at least one connecting rod driving said ram, a base plate defining the lower limit of a punching work space and guide columns operative to guide said ram, in which said ram comprises a plurality of guide sleeves projecting therefrom towards said base plate; in which every guide column is mounted to said base plate and projects into a respective guide sleeve; and in which every guide column is provided with pistons rings sealing against the respective sleeve, each piston ring having a joint portion which is not aligned in an upright direction with the joint portion on an adjacent piston ring.

2. The ram guiding apparatus of claim 1, in which every guide column comprises a leakage oil channel extending therethrough in the longitudinal direction thereof, which leakage oil channel communicates with an oil collecting chamber located within said base plate.

3. The ram guiding apparatus of claim 2 and including an oil collecting ring located on said ram intended to collect leakage oil, in which said ram is provided with a transfer channel extending therethrough and terminating at one end at said oil collecting ring and at the other end at an inner chamber in a guide sleeve, which inner chamber is located above the guide column projecting into the guide sleeve and in which a check valve is located in said transfer channel having a horizontally movable valve body.

4. The ram guiding apparatus of claim 1, in which every guide sleeve is releasably mounted to said base plate, whereby every guide sleeve is replaceable together with its guide column as one unit without disassembling the punch press.

5. The ram guiding apparatus of claim 1, in which every guide sleeve is displaceable relative to its guide column in a horizontal direction such to allow for a thermal expansion, which direction is defined at least approximately by a straight line connecting the axes of the guide columns located diametrically opposite to each other relative to the center point of the base plate.

6. The ram guiding apparatus of claim 5, in which every guide column is provided with a head section projecting into a guide member, which guide member is not horizontally displaceable relative to the respective guide sleeve but displaceable relative to said head section in the direction of the extent of said straight line.

7. The ram guiding apparatus of claim 5, in which every guide column has at least approximately an elliptical shape and the major axis of the at least approximate ellipse extends perpendicularly to said straight line.

8. The ram guiding apparatus of claim 5, in which every guide column comprises an eccentrically arranged trunnion at its face side which trunnion projects into a guide member which is rotatable inside of the guide sleeve.

* * * * *